US006481047B1

(12) United States Patent
Schaefer

(10) Patent No.: US 6,481,047 B1
(45) Date of Patent: Nov. 19, 2002

(54) LINT VACUUM

(76) Inventor: William S. Schaefer, 28498 Kathy Rd., Rocky Mount, MO (US) 65072

( * ) Notice: Subject to any disclaimer, the term of this patent is extended or adjusted under 35 U.S.C. 154(b) by 0 days.

(21) Appl. No.: 09/943,868

(22) Filed: Aug. 31, 2001

(51) Int. Cl.[7] ..... A47L 7/00

(52) U.S. Cl. ..... 15/314; 15/323; 15/327.1; 15/328; 15/339

(58) Field of Search ..... 15/314, 328, 339, 15/323, 327.1

(56) References Cited

U.S. PATENT DOCUMENTS

| | | | | | |
|---|---|---|---|---|---|
| 3,009,188 | A | * | 11/1961 | Martin | 15/330 |
| 3,030,650 | A | * | 4/1962 | Kiraly | 15/310 |
| 3,213,480 | A | * | 10/1965 | Miller | 15/314 |
| 3,238,556 | A | * | 3/1966 | Martin | 15/330 |
| 3,238,706 | A | * | 3/1966 | Kurlinski | 15/327.1 |
| 3,714,765 | A | * | 2/1973 | Simonelli | 15/314 |
| 4,729,147 | A | * | 3/1988 | Armbruster | 15/314 |
| 5,535,478 | A | | 7/1996 | Thompson | |
| 5,893,194 | A | * | 4/1999 | Karmel | 15/301 |
| 5,904,160 | A | | 5/1999 | Wright | |
| 6,038,732 | A | | 3/2000 | McKnight et al. | |

* cited by examiner

*Primary Examiner*—Chris K. Moore
(74) *Attorney, Agent, or Firm*—Grace J. Fishel

(57) ABSTRACT

A vacuum cleaner device for cleaning lint from lint traps of clothes dryers and the like provides the power of full size vacuum cleaners without requiring lifting or maneuvering of a heavy full size machine. The device may be semi-permanently or permanently attached to the left or right sides of a dryer by fasteners including magnetic fasteners. The device may have compartments for a motor and fan unit, for a filter bag and for a vacuum cleaner hose. The relative position of the filter bag and the connection between the vacuum cleaner hose, in relation to the enclosure of the vacuum cleaner device, may be rotated one hundred eighty degrees, by use of a removable connecting partition.

18 Claims, 5 Drawing Sheets

LINT VACUUM

BACKGROUND OF THE INVENTION

1. Field of the Invention

The present invention relates to the field of vacuum cleaning devices. More particularly, the present invention relates to the field of special vacuum devices for use in households, laundries, cleaning establishments and the like.

2. Brief Description of the Prior Art

The disclosures of the following U.S. patents are incorporated by reference herein: U.S. Pat. Nos. 5,535,478, 5,904,160 and 6,038,732.

As noted in U.S. Pat. No. 5,904,478, it is desirable to provide for vacuum removal of lint from the lint traps of clothes dryers and the like. For example, manual removal of the lint from the lint trap may scatter fibers into the surrounding environment causing breathing problems and even fire hazard.

The prior art has dealt with these problems by directly vacuuming the lint into a vacuum cleaner. The vacuum cleaner may be a standard vacuum, such as a conventional upright vacuum cleaner, using a specifically designed tool to mate with the opening of a dryer lint trap. Alternatively, the vacuum cleaner may be of the smaller hand held type. The hand held vacuum cleaner may be battery powered and may also be equipped with a specifically designed tool to mate with the opening of a dryer lint trap.

Each of these devices has an advantage. A standard vacuum cleaner has a larger capacity for soil and lint. In addition, the standard vacuum cleaner can generate a greater pressure drop, resulting in a greater air flow through the vacuum cleaner, and is more effective at removing lint. The hand held vacuum cleaner is lighter and more convenient to move. In addition, a hand held vacuum cleaner can be stored near the clothes dryer.

BRIEF SUMMARY OF THE INVENTION

In view of the above, it is an object of the present invention to provide a vacuum cleaning device for dryers and the like that combines the advantages of standard vacuum cleaners and hand held vacuum cleaners in a novel way. It is another object to provide a vacuum cleaning device for dryers and the like that is selectively attachable to the housing of a dryer or the like at a plurality of locations. It is also an object to provide a vacuum cleaning device for dryers and the like that has a housing with space in the housing to store a vacuum cleaner hose. Another object is to provide a vacuum cleaning device for dryers and the like which can use conventional and non-standard nozzles, brushes and the like. Other objects and features of the invention will be in part apparent and in part pointed out hereinafter.

The vacuum cleaning device of the present invention uses a housing which may be permanently or semi-permanently attached to a dryer or the like. The housing is not moved when the vacuum cleaning device is in use. Cleaning is accomplished by use of movable hoses, such as conventional vacuum cleaner hoses, which are light in weight. The housing is robust enough to permit a full size vacuum cleaner motor and fan to be installed in the housing. Further, the housing may have an internal space in which the vacuum cleaner hose or hoses may be stored when the vacuum cleaning device is not in use.

This arrangement permits considerable flexibility in use of the vacuum cleaner. The vacuum cleaner can reach lint traps in all conventional placements on a dryer, both internal lint traps, i.e., inside the dryer door, and those having access through the top of the dryer. Further, the vacuum cleaner device of the present invention may be selectively installed in a plurality of locations on a dryer or the like, as desired by the user. As installed, the device of the invention is compact and uses a minimum of space.

The present invention provides all of the desirable features of large standard type vacuum cleaners and all of the desirable features of small hand held vacuum cleaners. The device of the present invention can use vacuum nozzles, brushes and the like which are specifically designed for lint traps and can also use standard or conventional tools. If desired, no tools, other than a standard hose inlet, may be used.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
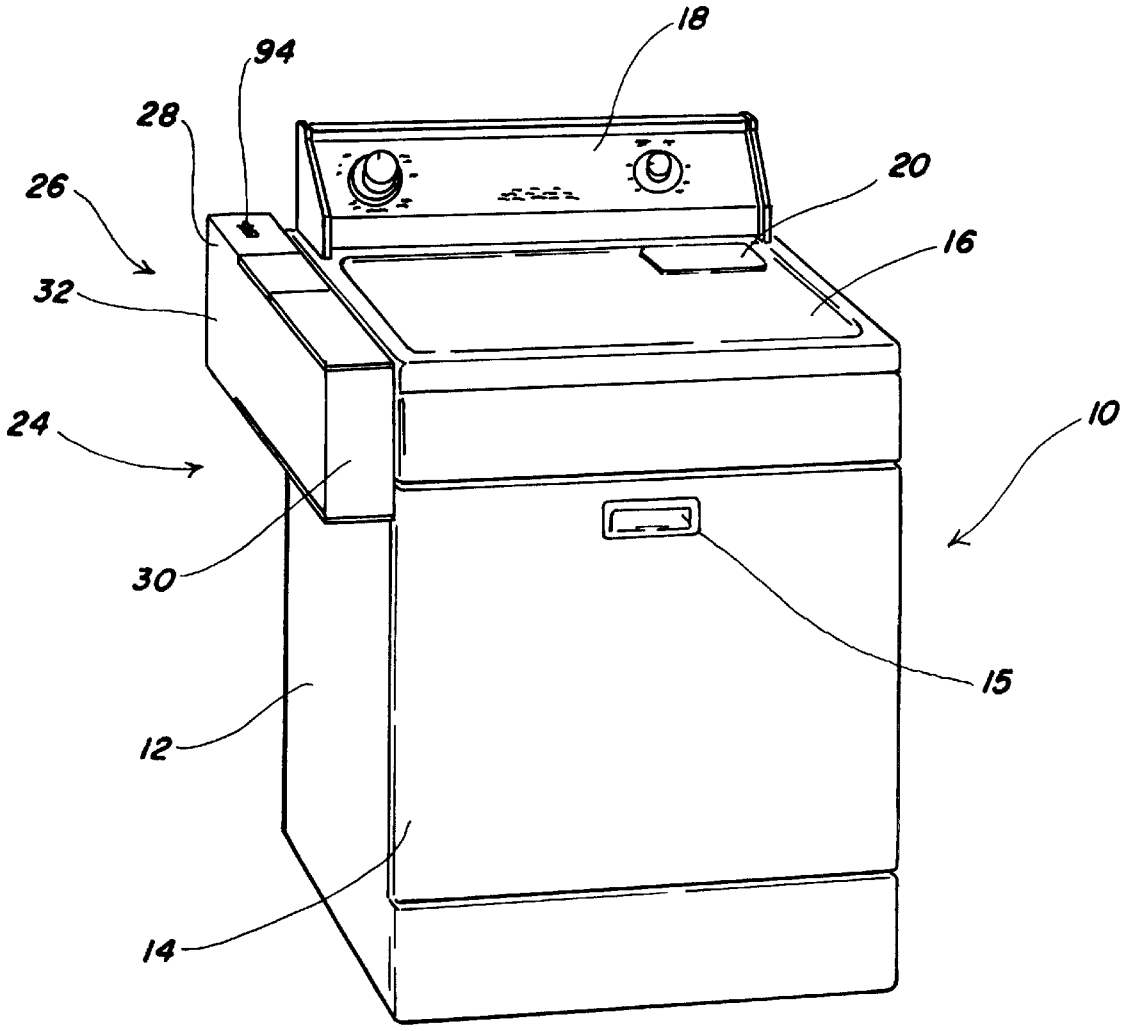
FIG. 1 is a perspective view of a clothes dryer having a vacuum device according to the invention attached to the left side of the clothes dryer.

Referring to FIG. 1, a clothes dryer 10 is shown having a housing 12 and a front loading door 14 with a handle 15. Clothes dryer 10 has a top 16 having a control panel 18. Top 1-6 has a hatch 20 providing access to a lint trap 22, shown in FIG. 2. A left side 24 of clothes dryer 10 is fitted with a vacuum cleaning device of the invention 26.

Figure 2:
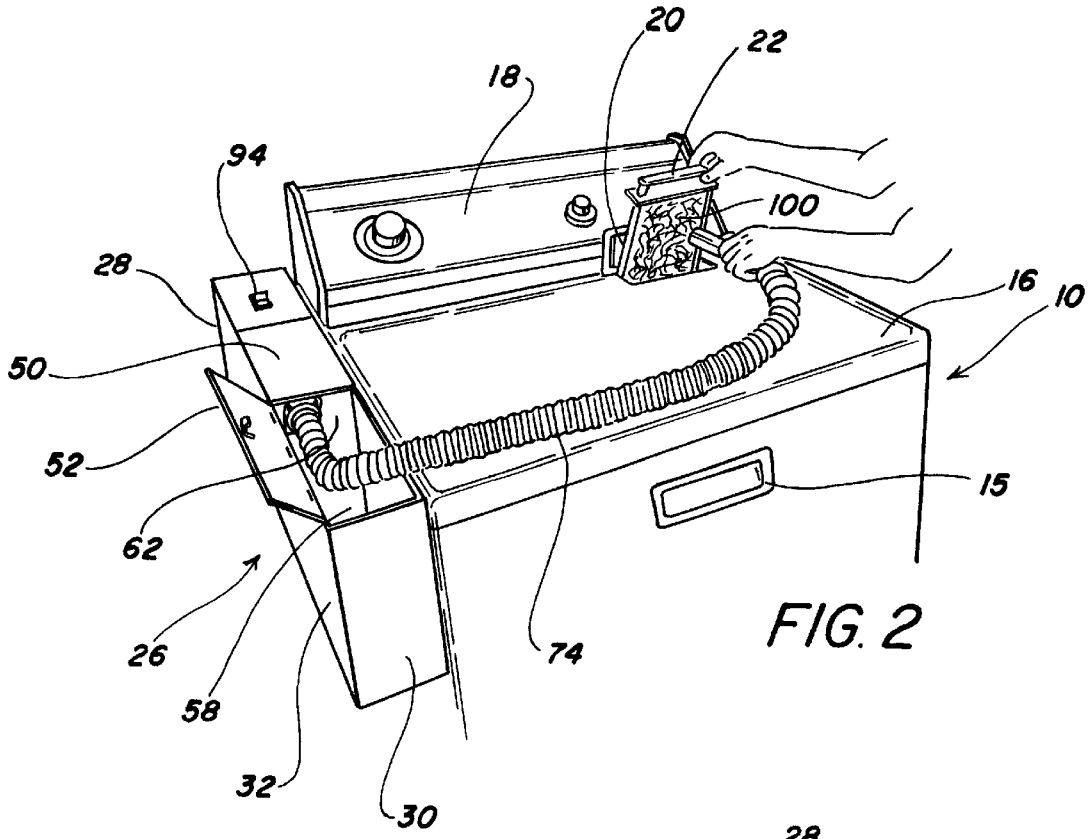
FIG. 2 is a partial perspective view of the clothes dryer of FIG. 1 showing the vacuum hose and hose compartment of the vacuum device.
Figure 3:
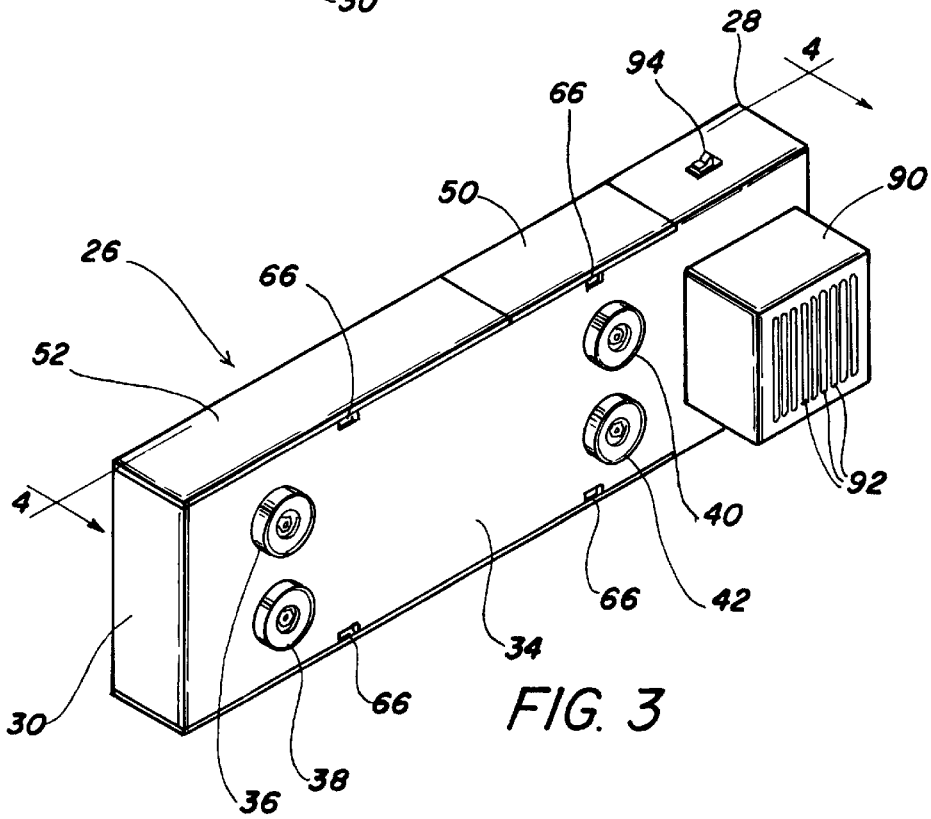
FIG. 3 is a perspective view of the vacuum device showing the inside or mounting surface of the vacuum device.

As shown in FIGS. 1–3, vacuum cleaning device 26 has an enclosure 28. Enclosure 28 may be made of a variety of conventional materials, as is known in the art. Enclosure 28 may be formed of sheet metal or conventional plastic materials. Suitable plastic materials may include polyethylene, polypropylene and similar materials. Conventional fabrication techniques, such as welding, die forming and molding may be used, as is known in the art.

Figure 4:
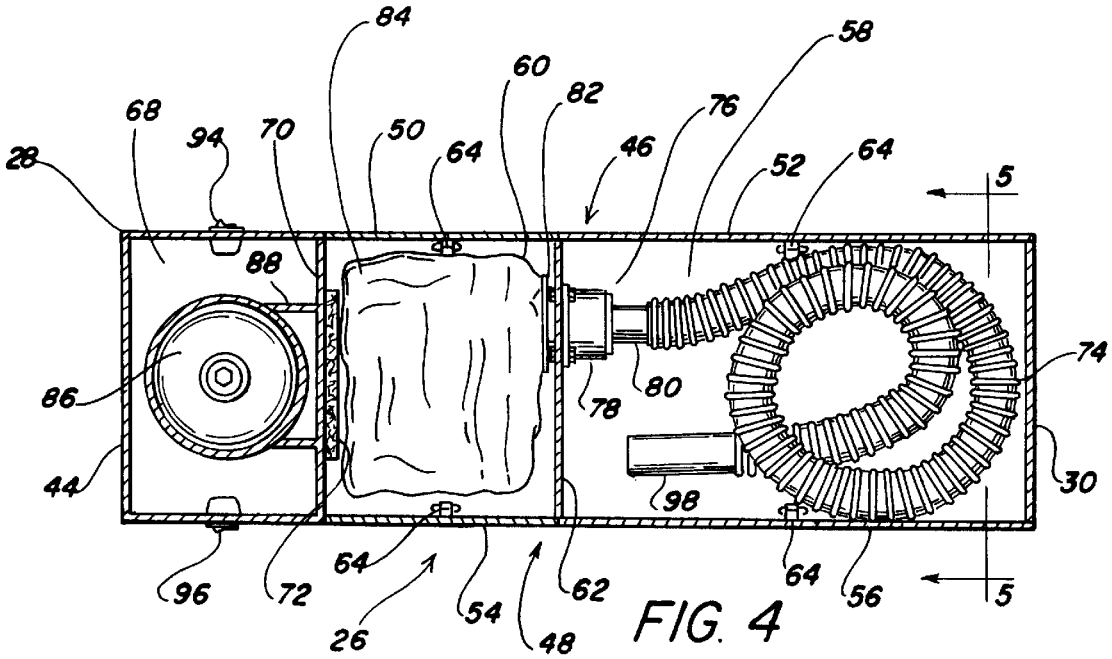
FIG. 4 is a cross-sectional view of the vacuum device taken along the plane 4—4 shown in FIG. 3.
Figure 5:
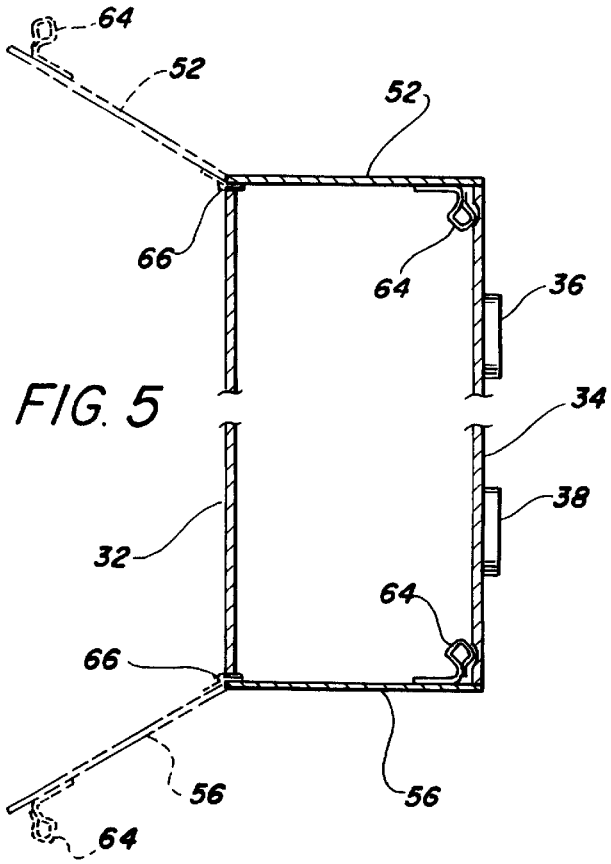
FIG. 5 is a partial cross-sectional view of the vacuum device taken along the plane 5—5 shown in FIG. 4.
Figure 8:
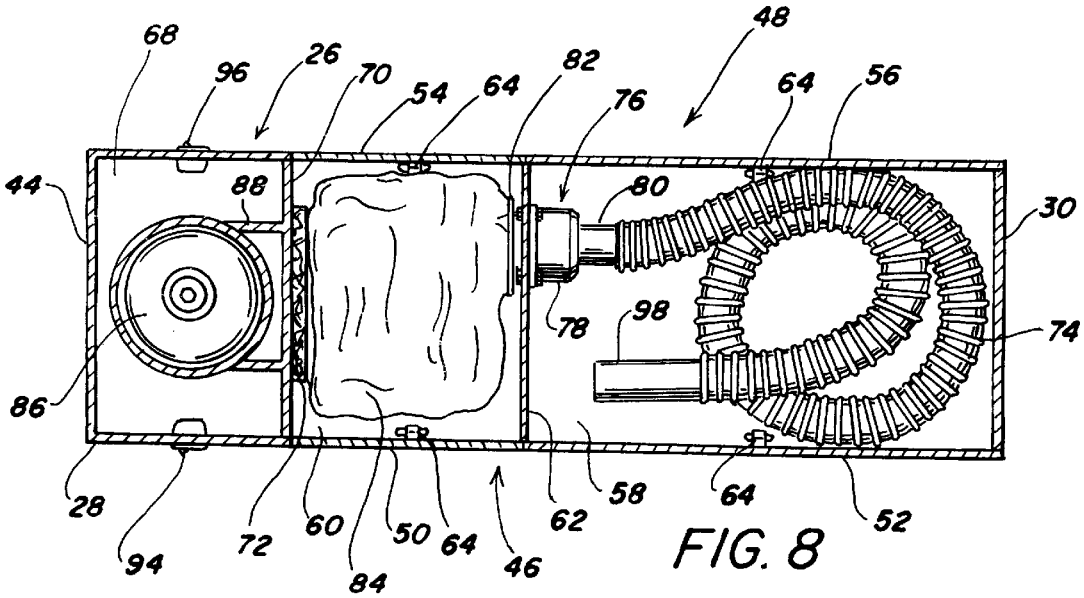
FIG. 8 is a cross-sectional view similar to FIG. 4 showing the inverted position of the removable partition; and, FIG. 9 is a partial perspective view of the vacuum device showing the removable partition bearing the cooperating fitting for attaching the vacuum hose to the filter bag.
Figure 9:
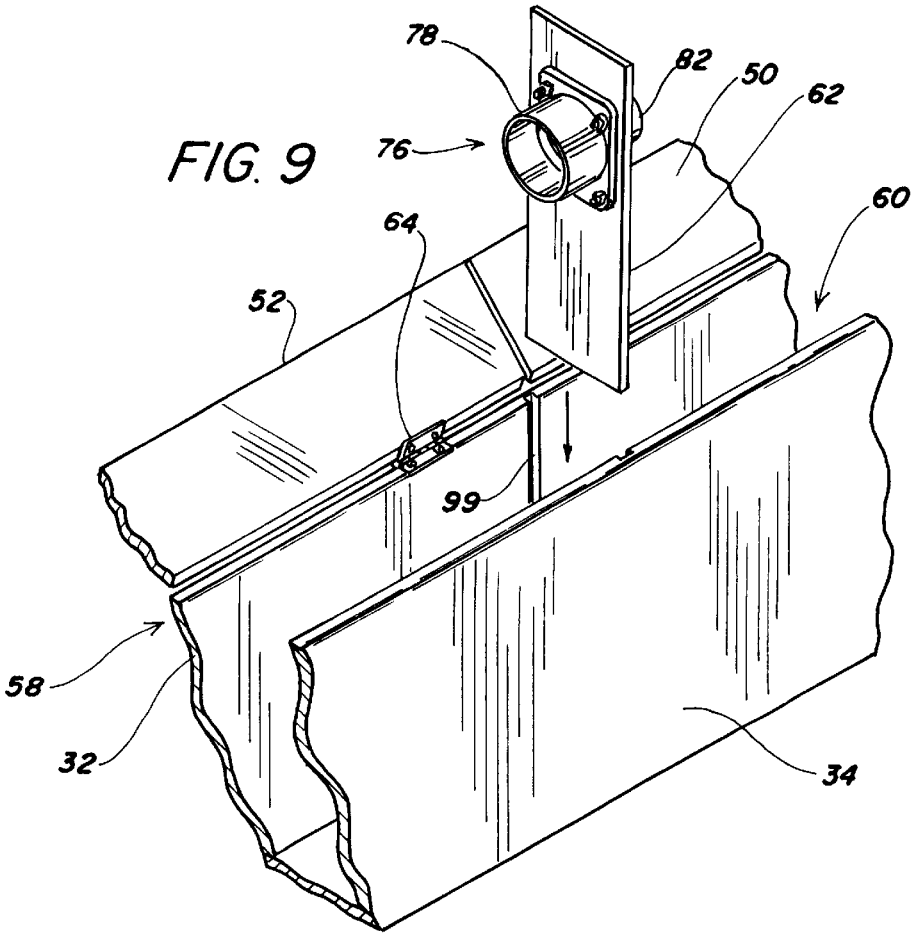

Enclosure 28 of vacuum cleaning device 26 has a proximal end panel 30 and an outside panel 32, as shown in FIGS. 1, 2, 5 and 9. As shown in FIGS. 3, 5 and 9, vacuum cleaning device 26 also has an inside panel 34 forming a mounting surface. Inside panel 34 is equipped with a set of magnets 36, 38, 40 and 42, as shown. In addition, vacuum cleaning device 26 has a distal end panel 44, shown in cross-section in FIGS. 4 and 8.

Enclosure 28 of vacuum cleaning device 26 has sectional upper and lower panels 46 and 48, as shown in FIGS. 4 and 8. Sectional upper and lower panels 46 and 48 form the top and bottom panels of enclosure 28. However, the relative positions of sectional panels 46 and 48 may be reversed, as shown in FIGS. 4 and 8 and as disclosed herein. Sectional panels 46 and 48 have hinged hatches 50, 52, 54 and 56 which provide access to compartments 58 and 60, shown in FIGS. 4 and 8. Compartments 58 and 60 are separated by a removable partition 62, as shown in FIG. 9. Hinged hatches 50, 52, 54 and 56 are closed by spring clips 64 or the like, as is known in the art. Hinged hatches 50, 52, 54 and 56 are fastened to inside panel 34 by hinges 66.

Enclosure 28 has a further compartment 68, as shown in FIGS. 4 and 8. Compartment 68 is separated from compartment 60 by a foraminous partition 70. Foraminous partition 70 may have a filter 72 cooperating therewith. As shown in FIGS. 4 and 8, filter 72 may be placed in compartment 60. Preferably, filter 72 is selectively removable and replaceable, as is known in the art.

Compartment 58 may have a vacuum hose 74 therein. Vacuum hose 74 may be a conventional plastic vacuum hose, such as those used on shop vacuum cleaners and the like. Removable partition 62 may have a cooperating fitting 76 mounted therein. Cooperating fitting 76 provides communication between compartment 58 and compartment 60. Cooperating fitting 76 has a female end 78, disposed in compartment 58, which mates with a male end 80 of vacuum hose 74. Cooperating fitting 76 may also have a male end 82 which is disposed in compartment 60. Male end 82 of cooperating fitting 76 may engage a filter bag 84. Filter bag 84 may be a conventional disposable vacuum cleaner bag, such as those commonly made of filter paper. Other equivalent filter bags may also be used, such as those made of cloth.

Compartment 68 is adjacent to compartment 60, as shown. Compartment 68 has a conventional vacuum cleaner motor and fan unit 86 mounted therein. Motor and fan unit 86 are preferably of a capacity comparable to standard or full size vacuum cleaners or even of higher capacity. Compartment 68 is preferable of a size to accommodate motor and fan units 86 having such capacity. A plenum 88 of motor and fan unit 86 communicates with compartment 60 through openings, not shown, in foraminous partition 70 and through removable filter 72.

As shown in FIG. 3, plenum 88 of motor and fan unit 86 communicates with the interior of a motor case 90. Motor case 90 encompasses the motor, not shown, of motor and fan unit 86. Plenum 88 and the interior of motor case 90 further communicate with the ambient atmosphere through vents 92 in motor case 90. The motor of motor and fan unit 86 is preferably a conventional electric motor and it may be provided with electric power from a line source by conventional wiring and connectors, not shown, as is known in the art. Operation of motor of motor and fan unit 86 is preferably controlled by onoff switches 94 and 96, using a conventional three wire circuit, not shown, as is known in the art.

In use, vacuum cleaner device 26 of the invention may be conveniently mounted on most conventional dryers 10, and the like, in the configurations shown in FIGS. 1, 2, 6 and 7. The connection between dryer 10 and vacuum cleaner device 26 is preferably selectively attachable and removable. Conventional fasteners may be used to connect vacuum cleaner device 26 and dryer 10. For example, bolts, screws and even adhesives may be used. However, a preferred method of forming the connection is the use of magnets 36, 38, 40 and 42 shown in FIG. 3. These magnets 36, 38, 40 and 42 readily form a firm, but removable connection between dryer 10 and vacuum cleaner device 26 since housing 12 of conventional dryers 10 is typically made of sheet steel containing sufficient iron to form a magnetic connection.

Figure 6:
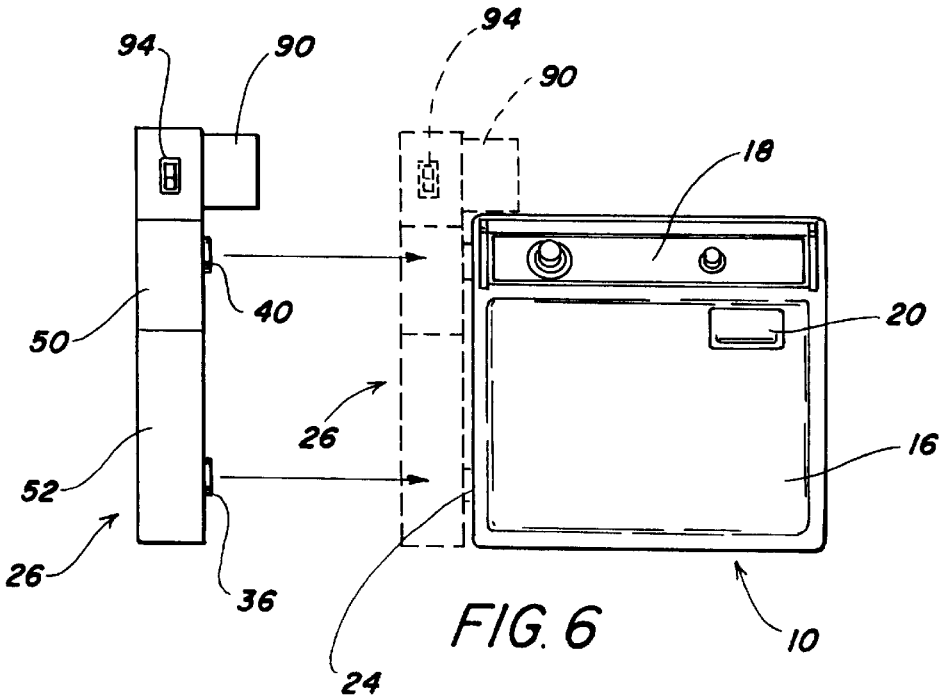
FIG. 6 is a top plan view of the clothes dryer of FIG. 1 showing the attachment of the vacuum device to the left side of the clothes dryer.
Figure 7:
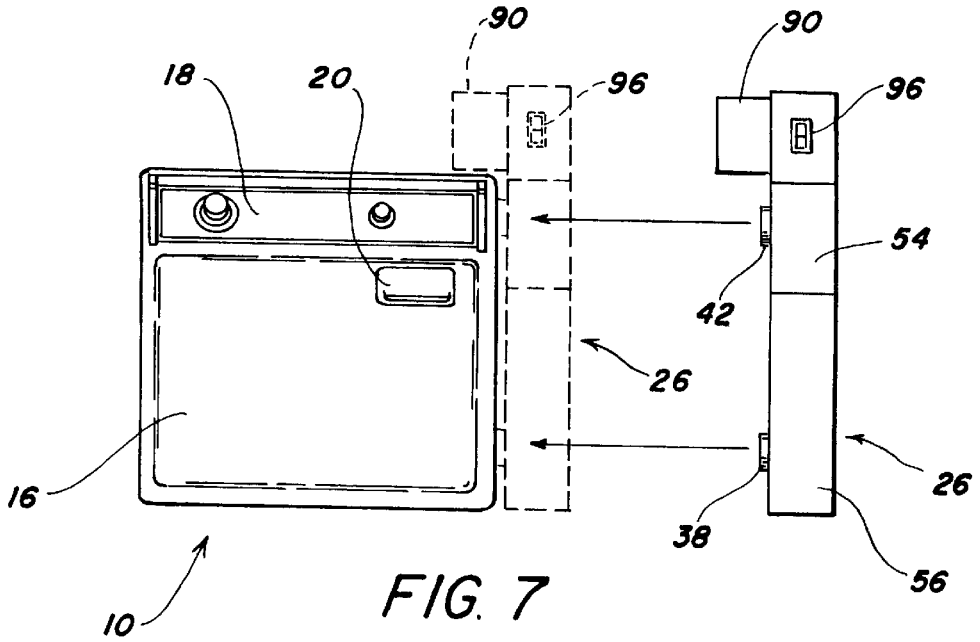
FIG. 7 is a top plan view of the clothes dryer of FIG. 1 showing the attachment of the vacuum device to the right side of the clothes dryer.

Vacuum cleaner device 26 may be attached to either the left side or the right side of dryer 10, as shown in FIGS. 6 and 7. Preferably vacuum cleaner device 26 is attached to the side of dryer 10, or the like, with motor case 90 positioned behind housing 12 of dryer 10. This positioning makes a more compact arrangement, since the space behind dryer 10 is largely unused, except by the exhaust vent from the dryer, not shown. The use of the plurality of on/off switches 94, 96 increases the convenience of use of vacuum cleaner device 26, since at least one of switches 94, 96 will be in reach in either the left or right configuration.

The left side to right side mounting flexibility of vacuum cleaner device 26 is further facilitated by removable partition 62, best seen in FIG. 9. It is preferred that the connection between vacuum cleaner bag 84 and fitting 82 be made at a location adjacent to the upper edge, or top, of vacuum cleaner bag 84. This configuration permits the removed lint to settle in the bottom of vacuum cleaner bag 84 and to not unduly obstruct the air flow through vacuum cleaner bag 84. However, when the connection of vacuum cleaner device 26 and dryer 10 is shifted from the left side to the right side, or the reverse, and motor case 90 is positioned behind housing 12 of dryer 10, vacuum cleaner device 26 must be inverted. That is, vacuum cleaner device 26 must be rotated one hundred eighty degrees around its longitudinal axis, placing the connection of vacuum cleaner bag 84 near the bottom. The desired configuration is restored by disconnecting vacuum cleaner hose 74 and vacuum cleaner bag 84 from removable partition 62. Removable partition 62 is removed from vacuum cleaner device 26, rotated one hundred eighty degrees and then returned to the vacuum cleaner device, as shown in FIG. 9. Vacuum cleaner hose 74 and vacuum cleaner bag 84 are then re-attached and vacuum cleaner device 26 is ready for use. It will be appreciated that the removable partition may be held in vacuum cleaner device 26 by conventional guides 99 or clips, not shown, or may be held in place by friction.

When vacuum cleaner device 26 is installed on dryer 10 it may be used by withdrawing vacuum cleaner hose 74 from compartment 58. Line current is supplied to motor and fan unit 86 by operating one of switches 9496. Free end 98 of vacuum cleaner hose 74 is placed near lint trap 22, as shown in FIG. 2, and lint 100 is drawn through vacuum cleaner hose 74 into filter bag 84. As will be appreciated, the device of the invention permits a powerful vacuum to be used without the necessity of maneuvering a heavy and\or cumbersome machine.

In view of the above, it will be seen that the several objects of the invention are achieved and other advantageous results attained. It will be appreciated by those skilled in the art that various changes and modifications of the embodiments disclosed herein may be made without departing from the invention. For example, compartment 58 could be eliminated to reduce weight, to reduce the size of the device, to reduce the cost of the device, or for other reasons. In this configuration housing 28 would terminate at removable partition 62. As various other changes could be made in the above constructions without departing from the scope of the invention, it is intended that all matter contained in the above description or shown in the accompanying drawings shall be interpreted as illustrative and not in a limiting sense.

What is claimed:

1. A vacuum cleaner for removing lint from a lint trap of a clothes dryers and the like, the vacuum cleaner having a housing, the housing having a plurality of compartments therein, the compartments including a first compartment for a motor and fan unit, the first compartment having a motor and fan unit therein, the compartments further including a second compartment for receiving lint removed from a dryer, the second compartment being adjacent to the first compartment and separated therefrom by a first partition, the first partition having an opening therethrough, the motor and fan unit having a plenum and the opening in the first partition communicating with the first and second compartments and further communicating with the plenum of the motor and fan unit, the housing having an opening therein spaced from the opening in the first partition and the plenum further communicating with the opening in the housing, the second compartment having a second partition, the second partition being spaced from the first partition, the second partition having an opening therethrough, the opening in the second partition being located asymmetrically in relation to the transverse axis of the second partition, the second partition being removable and reversible in the housing whereby the relative placement of the opening in the second partition to the housing may be changed.

2. The device of claim 1 wherein the opening in the second partition has a connector for a vacuum cleaner hose mounted therein.

3. The device of claim 2 wherein the connector has a fitting for mating with a filter bag.

4. The device of claim 3 wherein the second compartment contains a filter bag and the fitting extends into the second compartment.

5. The device of claim 4 wherein the first partition has a filter cooperating with the opening in the first partition.

6. The device of claim 2 wherein the device has a third compartment the third compartment being adjacent to the second compartment, the second compartment being separated from the third compartment by the second partition.

7. The device of claim 6 wherein a connector for a vacuum cleaner hose extends into the third compartment.

8. The device of claim 7 wherein the device has a vacuum cleaner hose in the third compartment the vacuum cleaner hose being connected to the connector and communicating with the second compartment through the second partition.

9. The device of claim 1 wherein the device has a fastener for selective removable attachment to a dryer.

10. The device of claim 9 wherein the fastener is a magnetic fastener.

11. The device of claim 9 wherein the fastener is removably attachable to a dryer at a plurality of locations on the dryer.

12. The device of claim 1 wherein the motor and fan unit has an electric motor and the electric motor has a plurality of switches.

13. A vacuum cleaner for removing lint from a lint trap of clothes dryers and the like, the vacuum cleaner having a housing, the housing having a plurality of compartments therein, the compartments including a first compartment for a motor and fan unit, the first compartment having a motor and fan unit therein, the compartments further including a second compartment for receiving lint removed from a dryer, the second compartment being adjacent to the first compartment and separated therefrom by a first partition, the first partition having an opening therethrough, the motor and fan unit having a plenum and the opening in the first partition communicating with the first and second compartments and further communicating with the plenum of the motor and fan unit, the housing having an opening therein spaced from the opening in the first partition and the plenum further communicating with the opening in the housing, the second compartment having a second partition the second partition being spaced from the first partition, the second partition having an opening therethrough the opening in the second partition being located asymmetrically in relation to the transverse axis of the second partition, the second partition being removable and reversible in the housing whereby the relative placement of the opening in the second partition to the housing may be changed, the compartment further including a third compartment, the third compartment being adjacent to the second compartment, the third compartment being separated from the second compartment by the second partition, the second partition having a connector for a vacuum cleaner hose mounted in the opening in the second partition, the connector extending into the third compartment and a vacuum cleaner hose in the third compartment being connected to the connector, and communicating with the second compartment through the second partition.

14. The device of claim 13 wherein the second and third compartments have top and bottom access hatches.

15. The device of claim 14 wherein the access hatches are hinged cover panels.

16. The device of claim 13 wherein the connector extends into the second compartment and the connector has a fitting in the second compartment for mating with a filter bag.

17. The device of claim 13 wherein the first partition has a replaceable filter cooperating with the opening in the first partition.

18. A vacuum cleaner attachment for removing the lint from lint traps of clothes dryers and the like, the vacuum cleaner attachment having means for selective attachment to and removal from a clothes dryer or the like, the selective attachment means being removably attachable to both the left side and right side of a dryer or the like, the vacuum cleaner attachment further having means for containing a filter bag in the vacuum cleaner attachment and having a vacuum cleaner hose, the vacuum cleaner attachment providing means for connecting the vacuum cleaner hose to a filter bag contained therein at a location adjacent to an upper portion of the filter bag, the vacuum cleaner attachment also having means for maintaining the location of the connection between the filter and the vacuum cleaner hose when the vacuum cleaner attachment is rotated one hundred eighty degrees about its longitudinal axis, whereby the vacuum cleaner attachment may be attached to a dryer or the like in a plurality of configurations.

* * * * *